United States Patent [19]

Aterianus

[11] 4,106,265

[45] Aug. 15, 1978

[54] WRAPPING MACHINE AND METHOD WITH FOUR SIDE ROTARY TUCKER

[75] Inventor: John S. Aterianus, Green Bay, Wis.

[73] Assignee: FMC Corporation, San Jose, Calif.

[21] Appl. No.: 581,993

[22] Filed: May 29, 1975

[51] Int. Cl.[2] ..... B65B 9/10; B65B 51/30

[52] U.S. Cl. ..... 53/180 R; 53/182 R

[58] Field of Search ..... 53/180 R, 180 M, 182 R, 53/182 M, 28, 373, 22 A; 93/12 R, 35 SR

[56] References Cited

U.S. PATENT DOCUMENTS

| | | | |
|---|---|---|---|
| 2,179,685 | 11/1939 | Chalmers | 93/12 R |
| 2,546,721 | 3/1951 | Campbell | 53/46 |
| 2,602,276 | 7/1952 | Campbell | 53/182 R |
| 2,603,925 | 7/1952 | Moore | 53/234 X |
| 2,605,597 | 8/1952 | Schelb | 53/182 R |
| 3,007,295 | 11/1961 | Heinzer | 53/180 R |
| 3,090,174 | 5/1963 | Kraft | 53/182 |
| 3,274,746 | 9/1966 | James et al. | 53/22 A |
| 3,347,015 | 10/1967 | Nutting et al. | 53/182 R |
| 3,439,471 | 4/1969 | Kraft | 53/182 R |
| 3,462,915 | 8/1969 | Anderson | 53/230 |
| 3,513,629 | 5/1970 | Hoagland et al. | 53/182 R |
| 3,629,987 | 12/1971 | Klopfenstein | 53/51 X |
| 3,657,856 | 4/1972 | Planner | 53/180 X |
| 3,738,081 | 6/1973 | Heinzer | 53/180 R |

FOREIGN PATENT DOCUMENTS

| | | | |
|---|---|---|---|
| 2,356,614 | 6/1974 | Fed. Rep. of Germany | 53/180 R |
| 1,362,060 | 7/1974 | United Kingdom. | |

*Primary Examiner*—Othell M. Simpson
*Assistant Examiner*—John Sipos
*Attorney, Agent, or Firm*—A. J. Moore; C. E. Tripp

[57] ABSTRACT

A wrapping machine and method is provided which forms a tube of wrapping material around spaced articles to be packaged. A four side rotary tucker cooperates with a crimping, sealing and cut-off mechanism to produce uniformly tucked, crimped end style packages with articles in packages after air has been discharged from reduced cut-off length with the result that wrapping material costs are minimized while package appearance is improved. The wrapping machine is readily adjustable to handle articles of different cross sections and lengths, and means are provided for removing air from the tube of wrapping material.

1 Claim, 22 Drawing Figures

SS
22
P
440
TS
20
24
23
37
36
416
32
26a
346
345
394
W
34
A
395
35
28
30
26
240
54
56
55
152
174
170
164
162
150
23'
240a
50
78
90
52
56
58
46
40
42
44
110

FIG_11
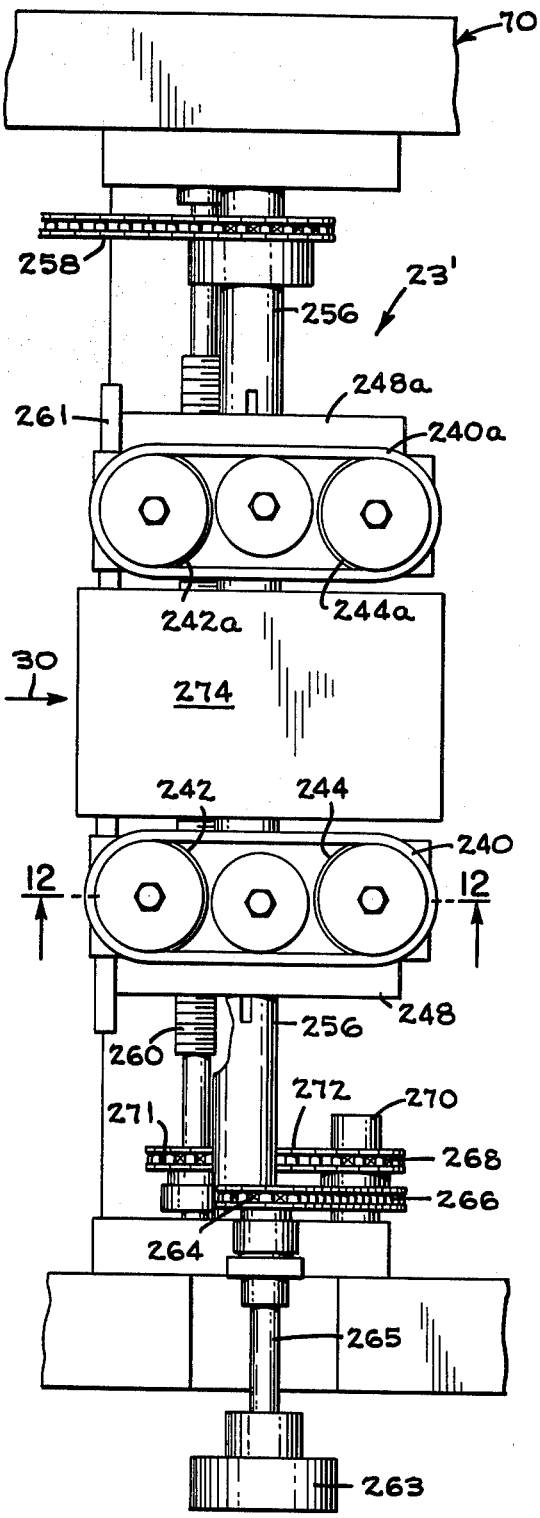
FIG_12
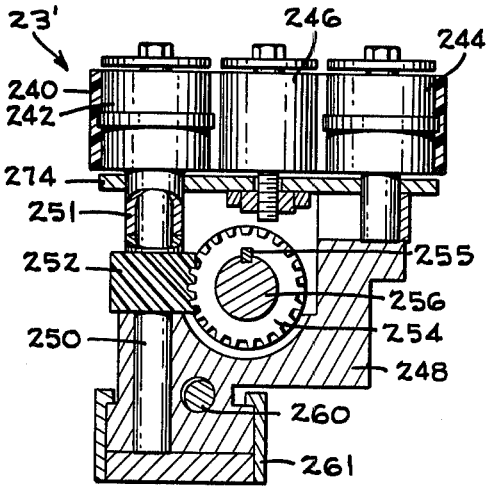
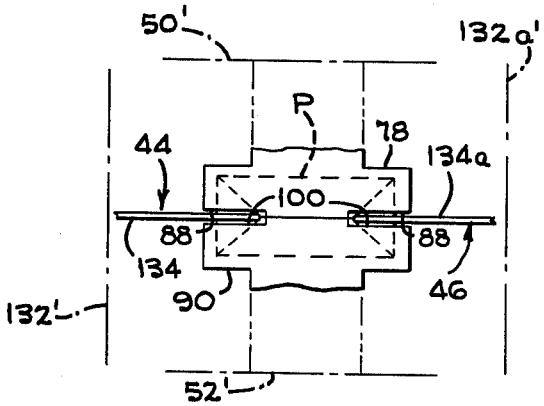
FIG_18
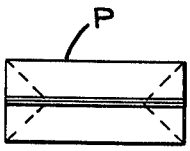
FIG_19

FIG_20
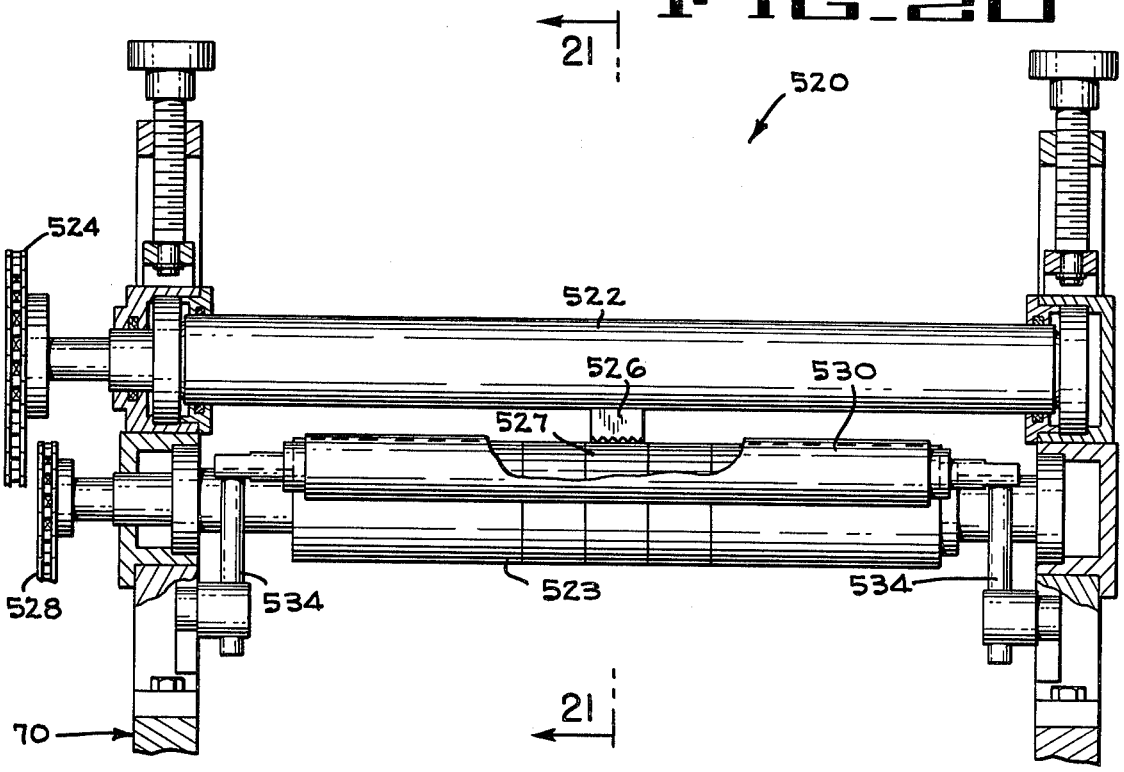
FIG_22
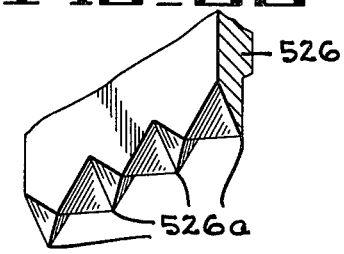
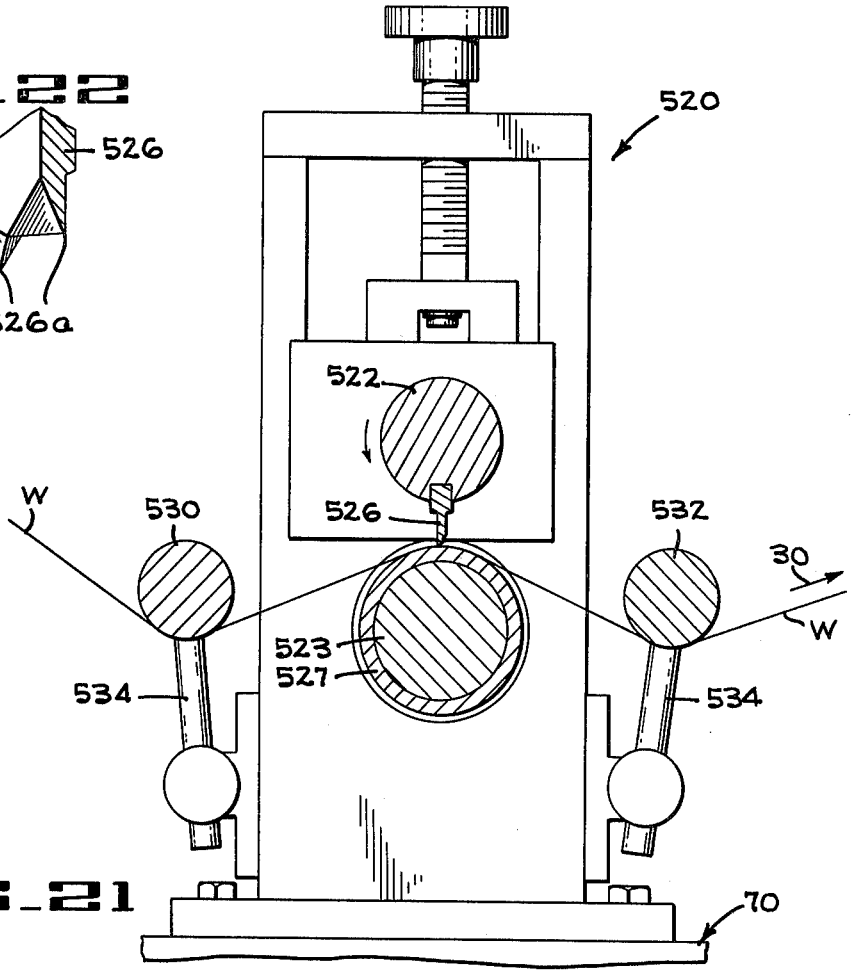
FIG_21

WRAPPING MACHINE AND METHOD WITH FOUR SIDE ROTARY TUCKER

BACKGROUND OF THE INVENTION

1. Field of the Invention

This invention pertains to wrapping machines for forming article filled, crimped end style packages formed from a flat web into a tube of wrapping material with the articles spaced therein. The machine simultaneously tucks all four sides of the film inwardly at a single station while evacuating substantially all the air from the packages resulting in a tighter tuck between the end extensions of the packages.

2. Description of the Prior Art

Wrapping machines which form tubes of wrapping material or film around spaced articles are well known in the art. Campbell U.S. Pat. No. 2,546,721 which issued on Mar. 27, 1951 discloses one such machine which forms article filled packages and utilizes pleating rollers on cam operated pivot arms to tuck in the package sides at a station upstream of the transverse crimping and cutoff station. Cam operated tuckers are now common in the art, however the method does not permit minimization of package length because the tuckers do not travel with the web while tucking and also cam pressure angles become excessive. The tucking operation reliability suffers when attempts are made to minimize package length.

The United States Patents to Kraft U.S. Pat. Nos. 3,090,174 which issued on May 21, 1973 and 3,439,174 which issued on Apr. 22, 1969 disclose the combination of a sealer and a tucker which provides tight tucks between spaced articles in a tube of wrapping material by tucking the material inwardly from all four sides. However, the Kraft patents utilize a series of equally spaced flexible tucking lugs attached to upper and lower flexible belts for tucking the upper and lower walls of a tube of wrapping material inwardly. Thus, Kraft's upper and lower tucker lugs are limited to a specific package size and cannot be adjusted to accommodate packages of different sizes. Kraft's unheated tucking lugs do not tack the flap material together at the tuck, and accordingly must remain in contact with the packaging material for a substantial linear distance and up to a point immediately adjacent the sealer.

SUMMARY OF THE INVENTION

The wrapping machine of the present invention forms a tube of wrapping film around a continuously moving row of relatively closely spaced articles. Air is evacuated from the tube of wrapping material at the tucking station either by drawing a vacuum through a flat vacuum tube inserted between the articles and the wrapping material, or by providing perforations in the wrapping material to allow for air escapement and subsequently sealing the end flaps over the perforations or between the perforations and the articles being packaged.

The spaced articles and tubular packaging material which preferably has a thermosealing or thermoplastic sealing medium are first conveyed through a tucking station comprising a rotary tucker, which simultaneously tucks all four walls of the tube of wrapping material inwardly while applying heat and pressure to the material in a manner which partially seals the tucked end extensions together.

Downstream belts disposed between the tucking station and sealing station engage the packaging material and enclosed articles being packaged and serve to tension the tubular material in the tucking zone thereby assuring that distinct tuck lines in the wrapping material commence from each of the four adjacent corners of the article. The downstream belts are driven faster than the infeeding tubular material and grip the packaging material with sufficient force to tension the tube but also allow slippage to occur between the belts and the tube during the foreshortening of the space between articles resulting from the tucking operation. Side tubing belts grip the articles upstream of the tucking station with sufficient force to prevent slippage in response to the tensioning forces induced downstream. These upstream and downstream belts assure proper tensioning of the tubular wrapping material to enable achieving sharp tuck or crease lines extending from and along each of the four corners of each end of the packaged article.

The partially sealed or tacked extended ends are then moved through a sealing and cut-off station at which time the tucked and partially sealed wrapping material between the foremost article and the next adjacent article is fully crimped and sealed, and the foremost end package is transversely severed from the tube of material.

The use of the four side rotary tucker results in packages with reduced cut-off lengths which minimizes wrapping material costs while package appearance is improved because the crimped ends are well tucked and extended a minimum amount from the packaged article. This improved tucking method and apparatus is particularly useful in the packaging of relatively high articles where a good tuck is essential to prevent an excessive and unattractive flaring out of the extended ends.

It is one object of the present invention to provide a continuous motion four side rotary tucking device for a wrapping machine.

Another object is to provide a wrapping machine which uses a minimum of wrapping material while packaging spaced articles.

Another object is to provide a method and apparatus for simultaneously tucking all four sides of a tube of wrapping material at a single station between spaced articles being wrapped.

A further object is to provide an improved method of packaging articles while using a minimum of wrapping material.

Another object is to provide a single station rotary tucking device which assures that all four tucker surfaces travel with the web at essentially matched velocity throughout the tucking operation.

Another object is to provide a drive system which enables adjustment of velocity and timing so that the tucking apparatus does not limit the size range adjustability of the wrapping machine.

Another object is to provide means for partially sealing the tucked extended end in the tucking station so the tuck can be maintained during subsequent transfer to a station for final cross crimping, sealing and severing.

Another object is to provide alternative means for preventing excessive air pressure buildup within the tube during the tucking operation.

BRIEF DESCRIPTION OF THE DRAWINGS

FIG. 11 is a plan of a downstream or output tubing belt assembly.

FIG. 12 is a section taken along lines 12—12 of FIG. 11.

FIG. 18 is a diagrammatic transverse section illustrating that the axes of rotation of the four tucking shoes are of equal radii and lie in a common transverse plane normal to the path of travel of the article.

FIG. 19 is an end view of a completed package.

FIG. 20 is a transverse section taken through an alternate embodiment illustrating a web perforating mechanism.

FIG. 21 is a longitudinal section taken along lines 21—21 of FIG. 20.

FIG. 22 is an enlarged perspective of a fragment of the perforating knife illustrating the shape of the web perforating teeth.

DESCRIPTION OF THE PREFERRED EMBODIMENT

The four side rotary tucker 20 (FIGS. 2 and 3) of the present invention cooperates with the sealing head assembly 22 and an input side tubing belt assembly 23 and an output tubing belt assembly 23′ of a wrapping machine 24 to seal articles A in packages P formed from a web W preferably of a thermosealing or thermoplastic wrapping material that is formed as a tube T (FIGS. 15–18) around the articles by the wrapping machine 24. The wrapping machine 24 is of the general type disclosed in assignee's U.S. Pat. No. 2,882,662 which issued to Campbell on Apr. 21, 1959 and which is incorporated by reference herein to illustrate web handling components and other features of the machine which are old in the art and are not fully disclosed herein.

Figure 1:
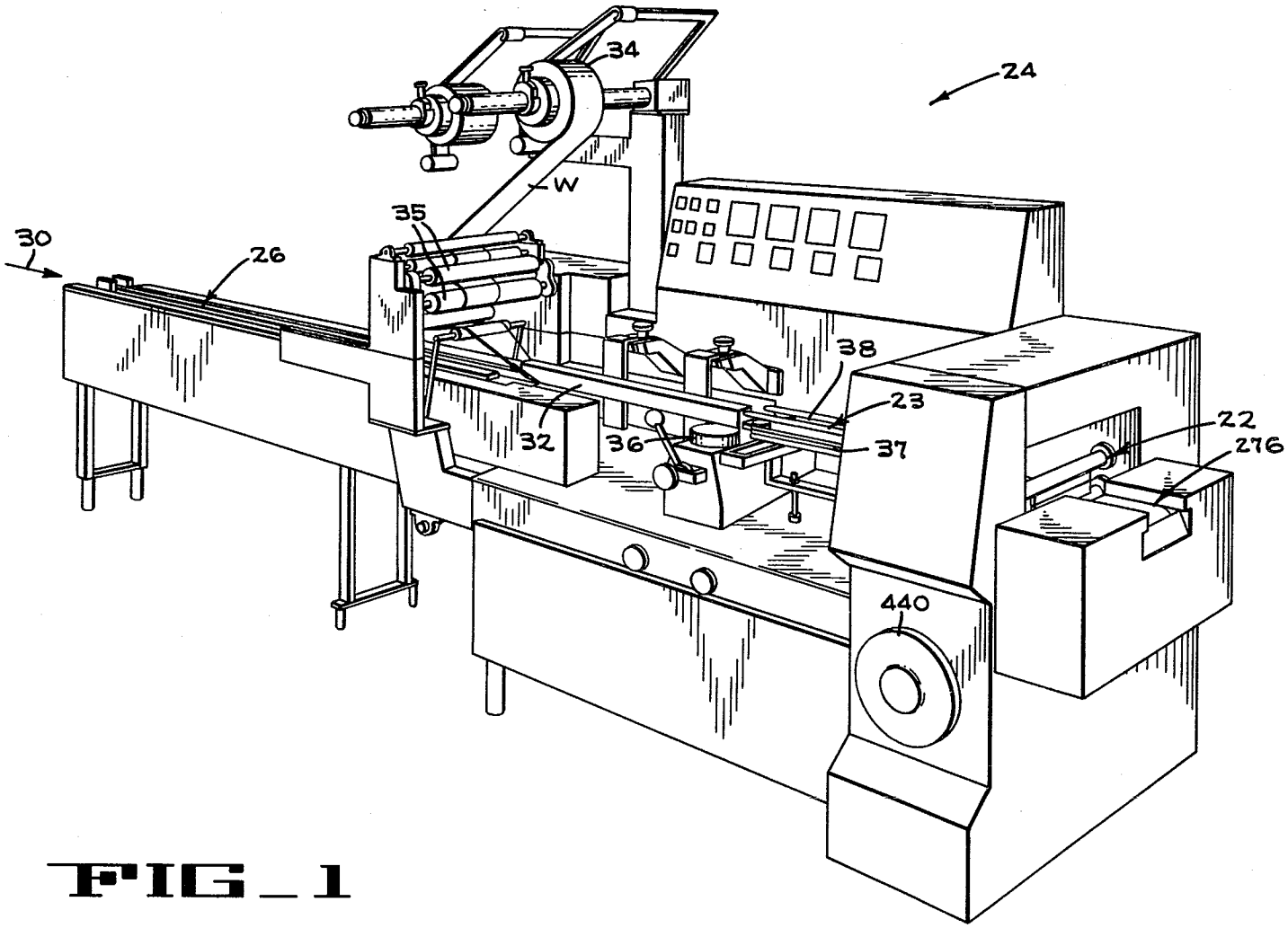
FIG. 1 is a perspective of a wrapping machine incorporating the four side rotary tucker of the present invention.
Figures 2, 3:
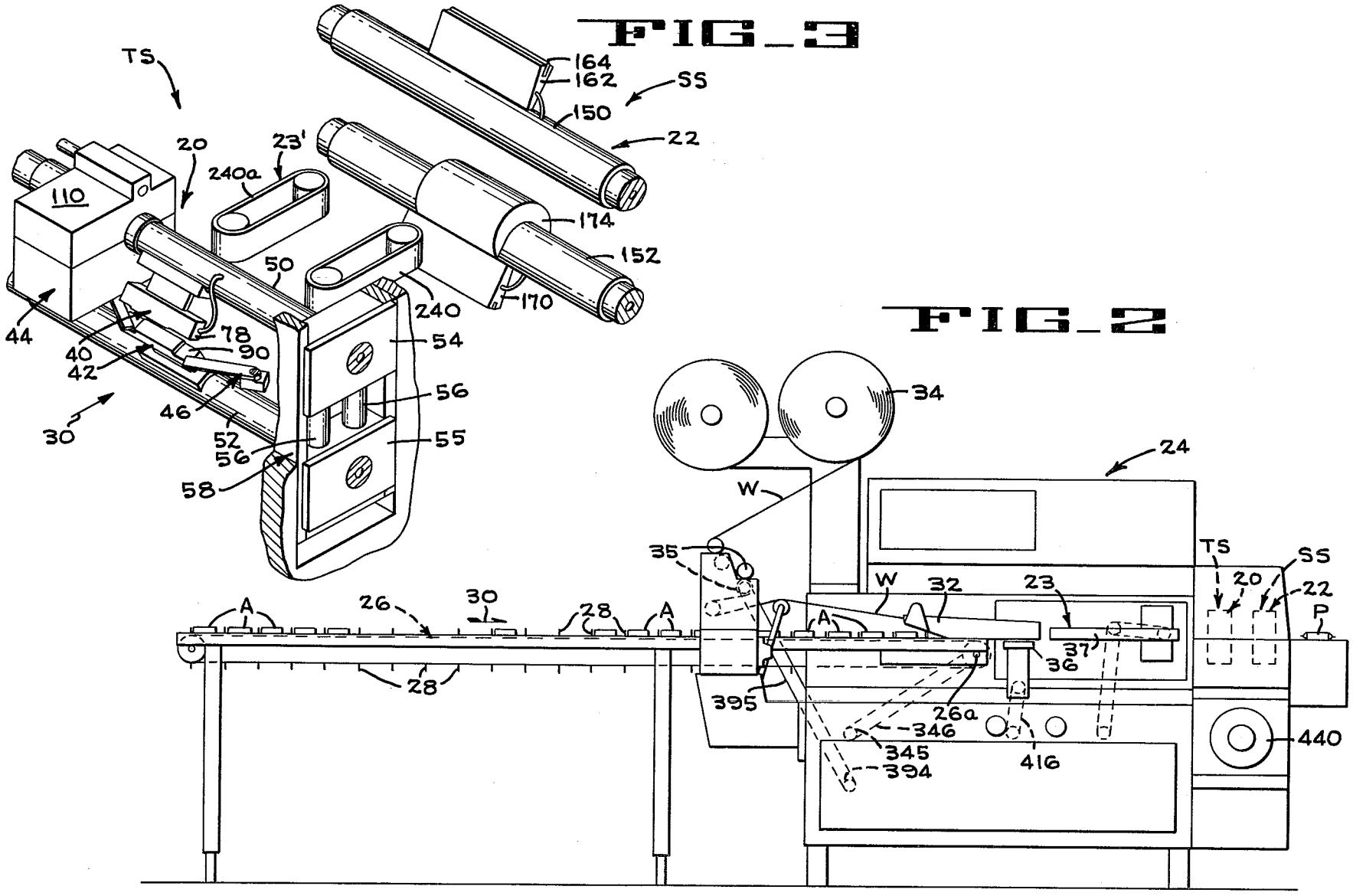
FIG. 2 is a diagrammatic side elevation of the wrapping machine of FIG. 1.
FIG. 3 is a diagrammatic perspective of the four side rotary tucker, sealing and severing mechanism and the downstream tubing belt assembly; certain parts being cut away.

In a manner conventional in the art, the articles A are placed at spaced intervals on an endless chain conveyor 26 and are driven by lugs 28 on the conveyor in the direction of the arrow 30 (FIGS. 1 and 2). The conveyor 26 moves the articles A through a web forming plough 32 which forms an endless tube T of web material around the spaced articles. The web W is drawn from a supply roll 34 by web feed rolls 35, is longitudinally sealed on its under surface by finwheels assembly 36, and is pulled through the tube forming plough 32 by driven input side belts 37 and 38 (FIG. 1) of the input belt assembly 23 disposed upstream of the rotary tucker 20. The input belts 37,38 grip the side walls of the tube T against the articles A with sufficient force to drive the articles while maintaining a desired spacing between articles as is well known in the art.

Figure 4:
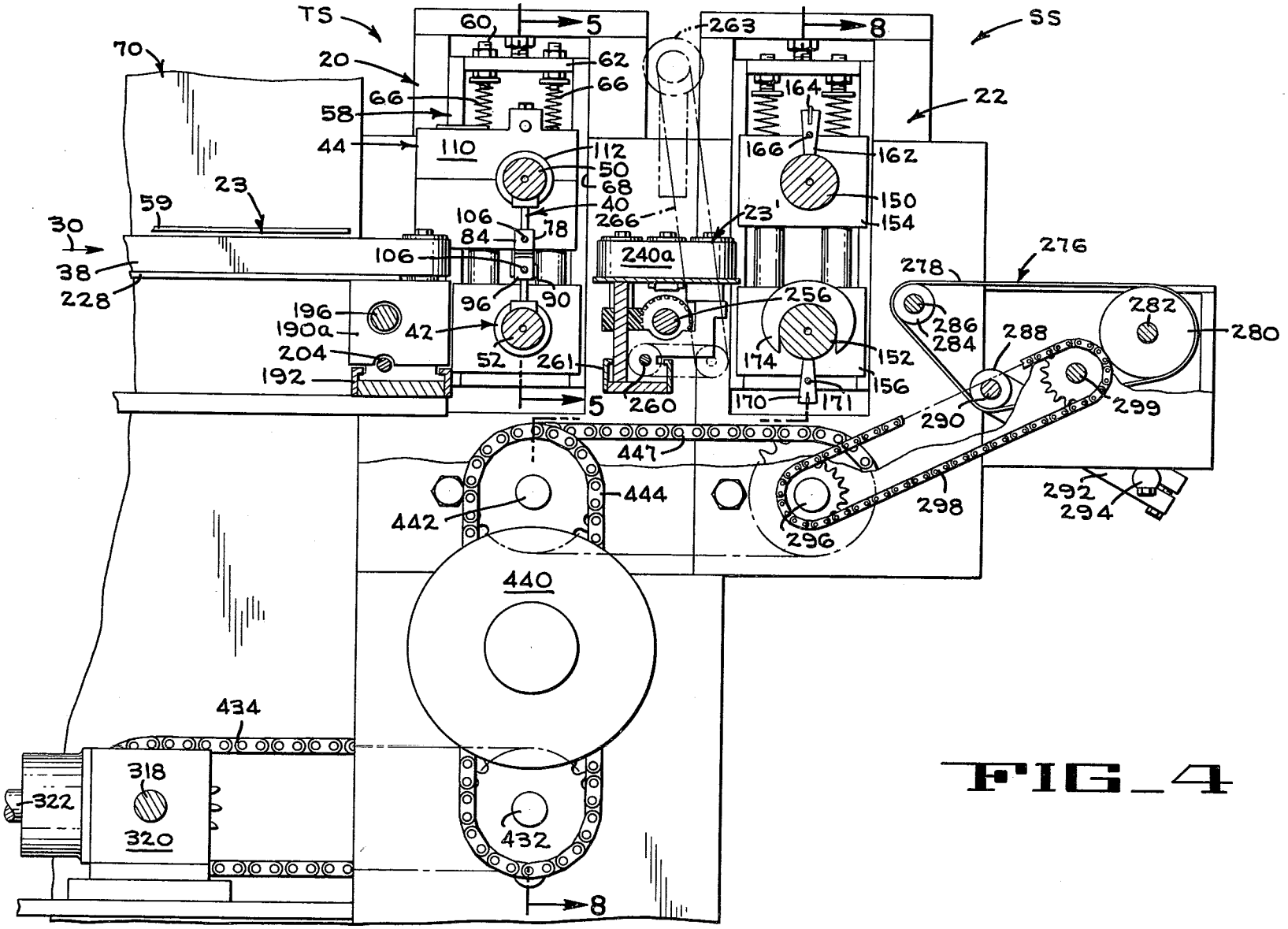
FIG. 4 is an enlarged side elevation of the tucking and sealing station with parts broken away and other parts shown in section.
Figure 5:
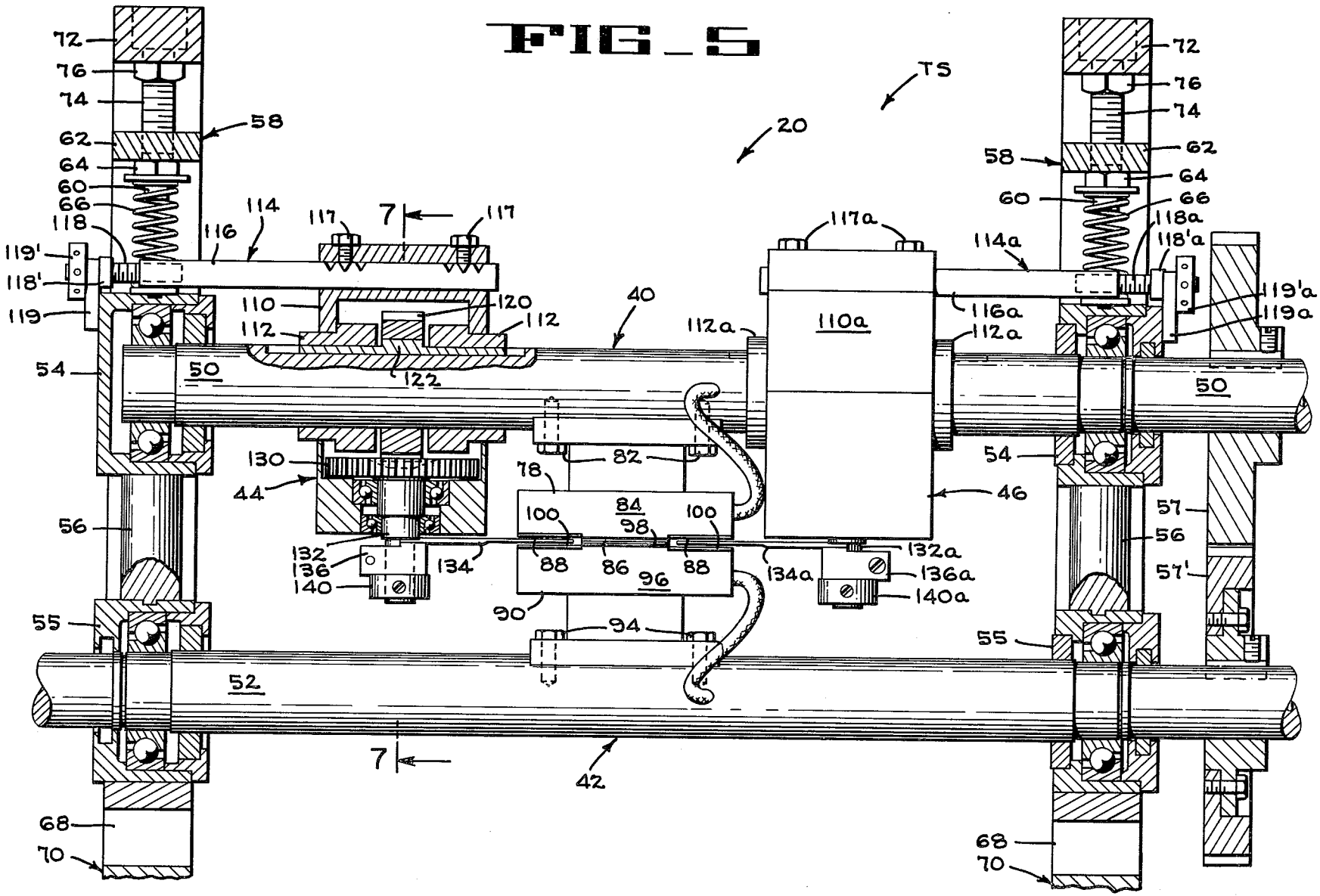
FIG. 5 is an enlarged transverse section taken along lines 5—5 of FIG. 4 illustrating the four side rotary tucker in tucking position.

As best shown in FIGS. 3–5, the four side rotary tucker 20 is located at a tucking station TS and comprises rotary upper and lower tucker assemblies 40,42 and rotary side tucker assemblies 44,46. The upper and lower tucker assemblies 40,42 are carried by upper shaft 50 and lower shaft 52 which are journaled in upper bearing blocks 54 and lower bearing blocks 55, respectively, having cylindrical spacer blocks 56 disposed therebetween. The shafts 50,52 are interconnected by meshing gears 57,57′ keyed thereto and being of equal size to drive the shafts at the same speed but in opposite direction. During tucking, air is withdrawn from the tube T by a flat vacuum tube 59 (FIGS. 15–17) which is connected to a suitable source of vacuum and extends from a position upstream of the tube of wrapping material T to a position adjacent the tucking station TS.

Figure 6:
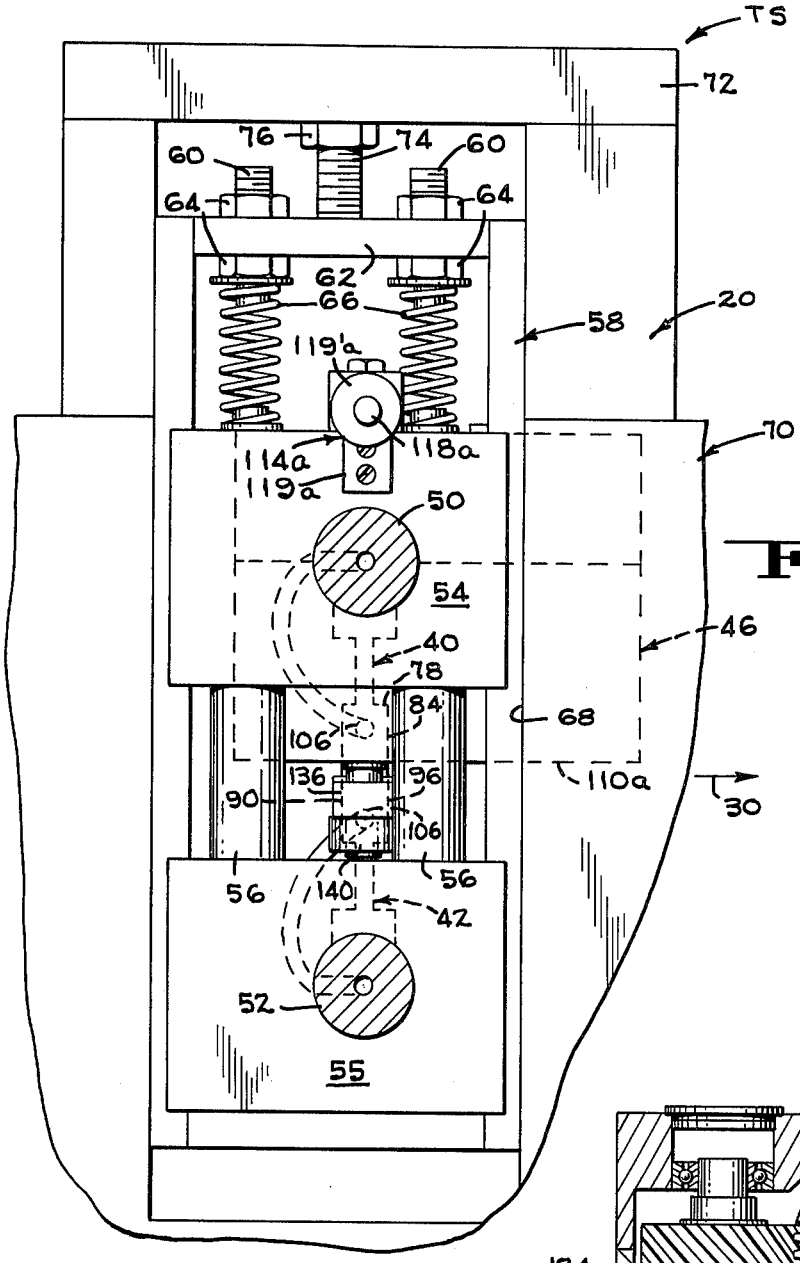
FIG. 6 is an enlarged side elevation illustrating the structure for mounting the rotary tucker for vertical adjustment enabling the unit to handle packages of different heights.

In order to accommodate batches of articles which may vary in vertical height, it is necessary to mount the shafts 50,52 for vertical adjustment to assure that the vertical midpoint of the articles A move along a horizontal path midway between the two shafts 50,52. In this regard, the bearing blocks 54,55 adjacent each end of the shafts are mounted in a vertical slide mechanism 58 (FIGS. 5 and 6) with the lower bearing or bearing block 55 being rigidly secured to the mechanism 58 and with the upper bearing or bearing block 54 being adjustable in the slide mechanism 58. A pair of studs 60 are secured to the upper bridge plate 62 of the slide mechanism 58 with nuts 64 thereon to adjust the downward pressure on the upper bearing blocks. Compression springs 66 are disposed between the upper bearing block 54 and the studs 60 to permit a limited amount of upward movement of the upper shaft 50 relative to the lower shaft 52. The slide mechanism 58 is slidably mounted in an upright slot 68 in the associated wall of the frame 70 of the wrapping machine 24. A bridge plate 72 covers each frame slot 68 and is apertured to slidably receive a capscrew 74 that is screwed into the bridge plate 62 of the slide mechanism 58 to lock the mechanism 58 in desired position by virtue of locknuts 76.

In the illustrated embodiment, the upper tucker assembly 40 (FIGS. 3, 4 and 5) includes a radial upper tucking shoe 78 that is rigidly secured to the upper shaft 5 by capscrews 82. The tucking shoe 78 has a web engaging foot 84, deflecting and bonding with an outer, arcuately curved central bonding portion 86 and flanked by similarly arcuately curved, but recessed side portions 88.

Likewise, a radial lower tucking shoe 90 is rigidly secured to the lower shaft 52 by capscrews 94. The tucking shoe 90 includes a web engaging, deflecting and bonding foot 96 having an arcuately curved central bonding portion 98 and flanked by similarly arcuately curved but recessed side portions 100.

The two tucking shoes 78 and 90 are diametrically opposed and are timed to lie in a common vertical plane containing the axes of both shafts 50,52 when the two shoes are tangent to horizontal planes and are tucking the web material together between two adjacent articles. The space between the web contacting surfaces of the central portions 86 and 98 of the upper and lower shoes when in the tucking position is approximately equal to four thicknesses of web material; for example, about 0.004 inches when the web material is one mil thick. The side portions of the upper and lower shoes are recessed to provide clearance for passage of the side tucker shoes.

In order to heat the upper and lower tucking shoes 78,90 to a bonding temperature, the shoes have heater cartridges 106 therein capable of raising the temperature of the web contacting surfaces of the shoes up to a bonding temperature. The cartridges are connected to slip rings (not shown) of an electrical power source by conductors that extend through bores in the shafts 50,52. Heating units of the above referred to type are conventional in sealing heads such as disclosed in the previously referred to Campbell U.S. Pat. No. 2,546,721 which patent is incorporated herein by reference.

Although only one tucker shoe has been illustrated on each shaft, it will be understood that it is desirable when packaging certain articles, such as short articles, to secure two diametrically opposed tucking shoes to each shaft 50,52.

Figure 7:
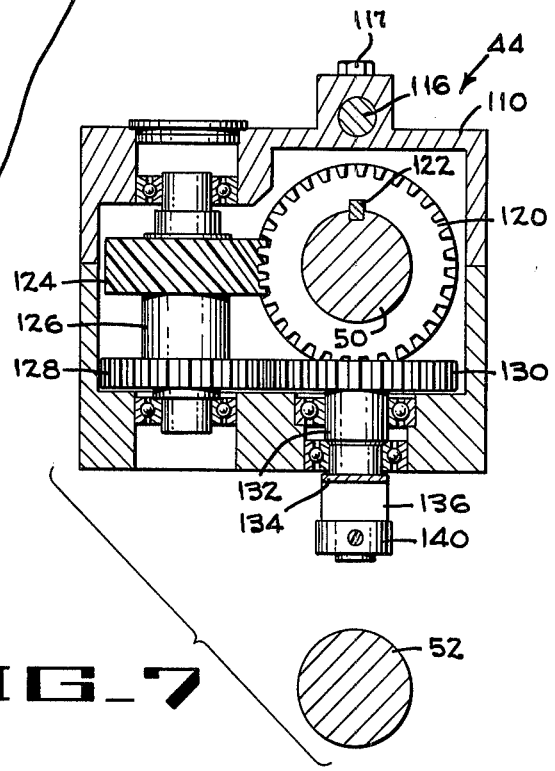
FIG. 7 is a vertical section taken along lines 7—7 of FIG. 5 illustrating a gear box for a side tucking unit.

Side tucker assemblies 44 and 46 are substantially the same and accordingly only the left side tucker assembly 44 (FIGS. 5 and 7) will be described in detail. Equivalent parts of the right tucker assembly 46 will be assigned the same numerals followed by the letter "*a*".

The left tucker assembly 44 includes a gear box 110 having bushings 112 that are journaled on the shaft 50. The gear box 110 is held from rotation and is adjusted longitudinally of the shaft 50 by an adjusting device 114. The device 114 includes an internally threaded rod 116 that is secured to the gear box 110 in one of a plurality of positions by set screws 117 and cooperating notches in the rod 116. One end of the rod is internally threaded to receive an externally threaded shouldered stud 118. The stud 118 includes an enlarged head 118' intermediate the ends thereof which abuts one side of an apertured bracket 119 bolted to the associated upper bearing block 54. A threaded portion of the stud 118 extends through the aperture in the bracket and has an adjusting nut 119' secured thereon. Thus, the gear box 110 may be adjusted longitudinally of the shaft 50 to vary the depth of side tuck by rotating the stud in either direction.

A helical drive gear 120 in the gear box 110 is connected to the shaft 50 by a high center key 122 in a keyway in the shaft for rotation with the shaft and axial movement relative thereto. The drive gear meshes with a driven helical gear 124 (FIG. 7) secured to a shaft 126 journaled in the gear box 110. A spur gear 128 rigid with the shaft 126 meshes with a gear 130 secured to an output shaft 132 that is journaled in the gear box 110 and projecting vertically downward. The top of the gear 130 is relieved to permit clearance for the helical drive gear 120.

A left side tucking shoe 134 is connected to a split block hub 136 which is rigidly secured to the output shaft 132 by a capscrew and a cooperating split block collar 140. The outer web engaging peripheral edge of the side tucking shoes **134,134*a* is formed as an arc having a radius equal to the length of the tucking shoes 134,134*a*, which radius is also equal to the radius of the outer periphery of the upper tucking shoe 78 and lower tucking shoe 90**.

Although only one side tucking shoe has been illustrated, it will be understood that the number of side tucking shoes used will correspond to the number of shoes used on the shafts 50 and 52.

As best illustrated in FIGS. 3 and 5 the cooperating sets of tucker shoes 78,90, 134 and **134*a* are all rotated about their axes 50', 52', 132', 132*a*' (FIG. 18) at the same speed and all shoes while in contact with the web simultaneously pass through their respective axial planes of symmetry, which plane is normal to the article path and containing the axes of the shafts 50,52, 132 and 132*a*. At this time, the four tucking shoes in engagement with the web are traveling in the same direction and at approximately the same linear speed as the web at the point of contact, which speed will be slightly slower than the speed of the articles A upstream of the four-side rotary tucker 20. It will also be noted that at this time the outer end portions of the side tucker shoes 134,134*a* lie within the space between the associated recessed side portions 88 and 100 of the upper and lower shoes 78 and 90**.

Figure 8:
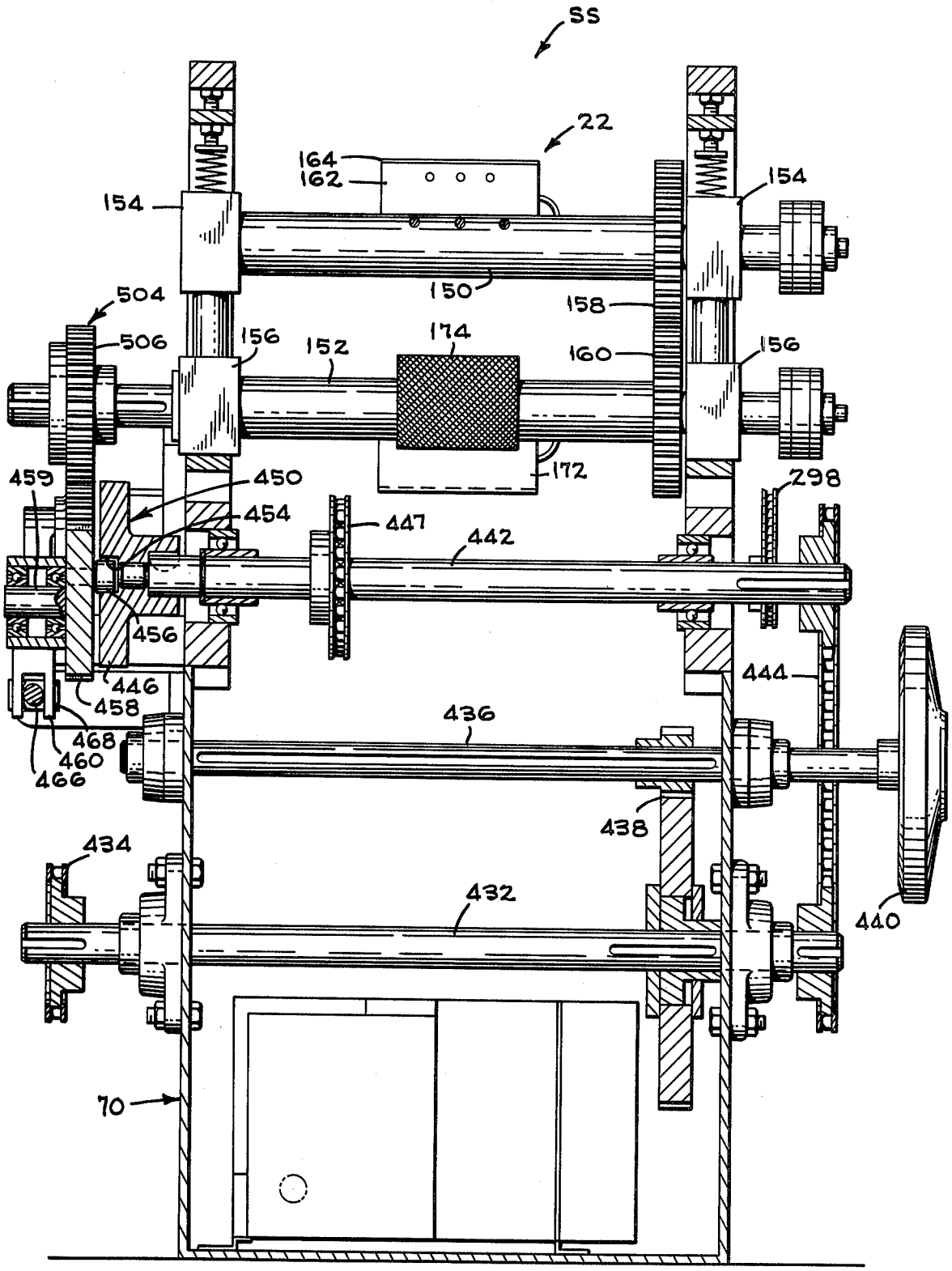
FIG. 8 is an enlarged vertical section taken along lines 8—8 of FIG. 4 illustrating the sealing head assembly and certain drive parts for the rotary tucker and sealing head.

As best illustrated in FIGS. 3, 4 and 8, the heat sealing and film severing head 22 is disposed at a sealing station SS downstream of the rotary tucker 20 and includes an upper shaft 150 and a lower shaft 152 journaled in bearing blocks 154 and 156, respectively, which bearing blocks are mounted on the frame 70 in a manner similar to the bearings blocks of the tucker. The shafts 150,152 are driven at the same speed and in opposite directions by meshing gears 158 and 160.

The upper shaft 150 carries a slotted crimper bar or shoe 162 which supports a knife 164 and an electrical heating cartridge 166 that is connected to a well known brush and slip ring assembly by conductors extending through a bore in the shaft 150. Similarly, a slotted crimper bar or shoe 170 which supports an anvil 172 is secured to the lower shaft 152 and has an electrical heating cartridge 171 therein that communicates with a brush and slip ring assembly by means of internal conductors. A knurled semi-cylindrical article support 174 is bolted to the lower shaft 152 and serves to support the articles entering the cutting and sealing station SS.

Since the tucking operation causes the film and space between the articles to foreshorten in the area between the tucking station and the sealing and severing station, it has been determined that the optimum timing is such that the tucker should complete the tucking operation before the heat sealing and film severing head contacts the film. Thus, the timing of the rotary tucker 20 relative to the heat sealing head 22 has been illustrated as being 180° out of phase of FIG. 4. If the longitudinal distance between the two heads is maintained constant, it will, of course, be understood that the timing of the heat sealing head relative to the tucking head may be changed so as to accommodate articles of different lengths.

As mentioned previously, it is desirable to apply a tension on the film tubing T and to evacuate air from the tube during the tucking operation in order to form firm tuck lines in the wrapping material from each of the four corners of the two adjacent articles.

Figure 9:
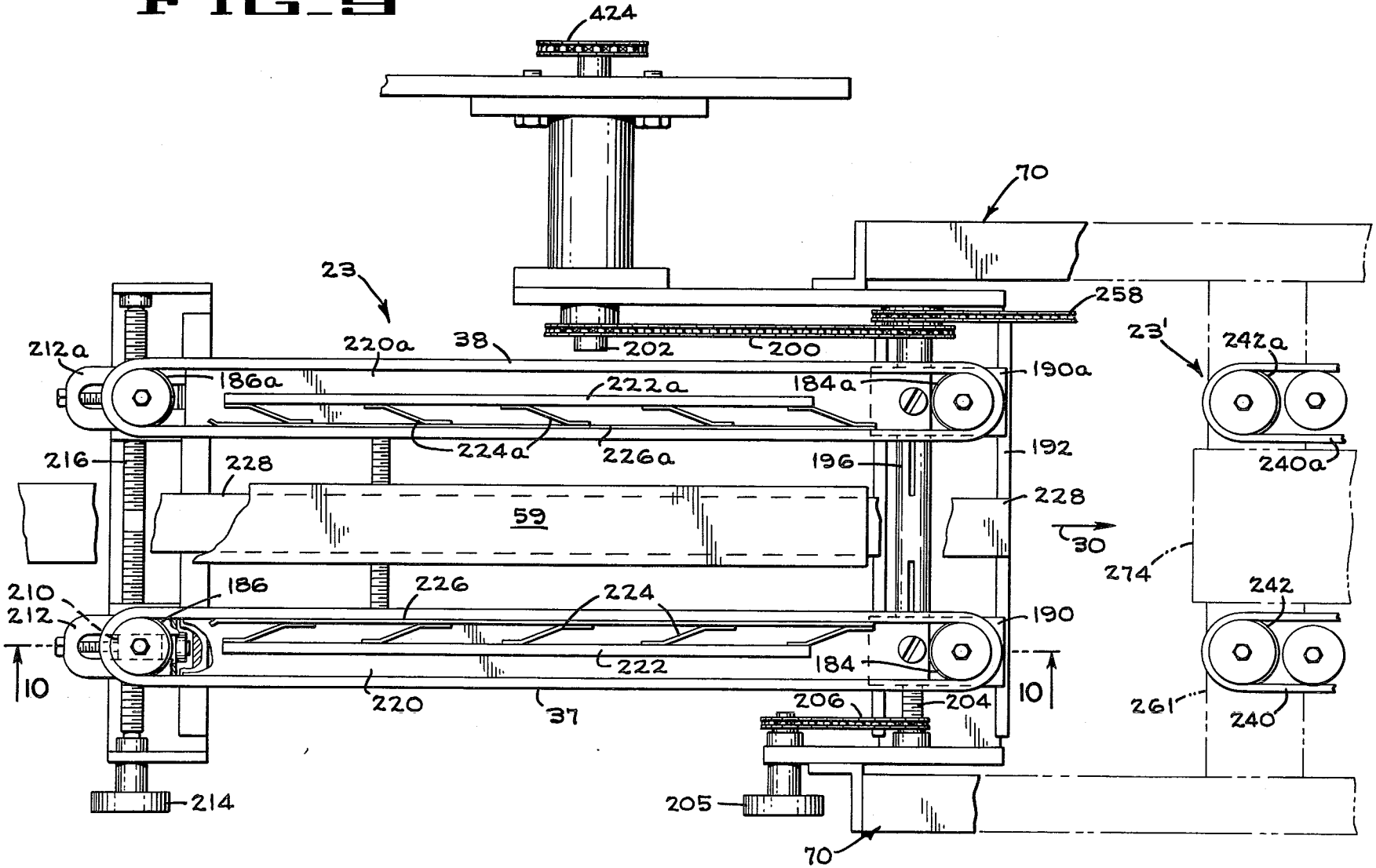
FIG. 9 is a plan of the input tubing belt assembly and a fragment of the downstream tubing belt assembly illustrating the structure for adjusting the input assembly for handling packages of different widths.
Figure 10:
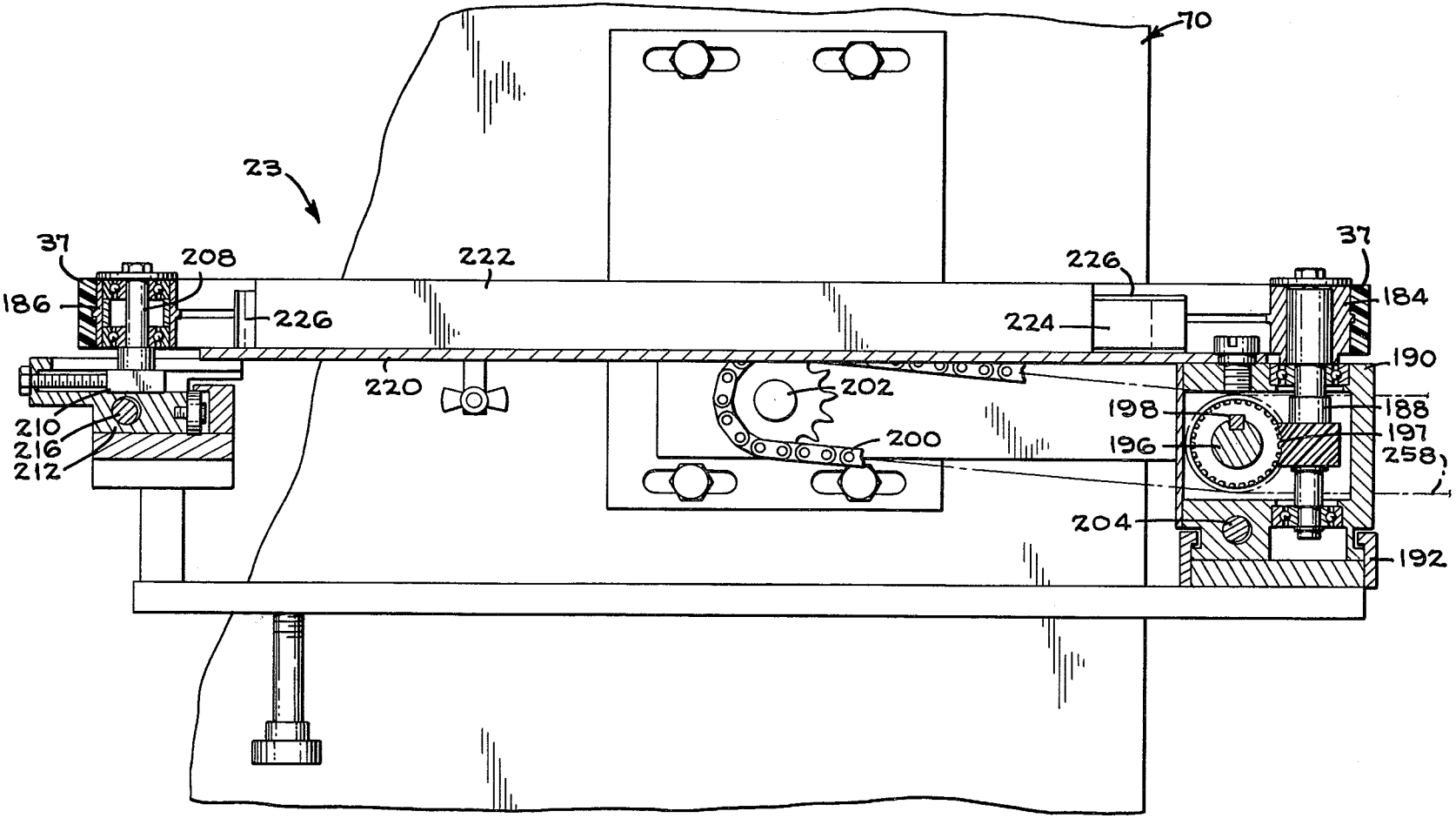
FIG. 10 is a section taken along lines 10—10 of FIG. 9.

For this purpose, the previously mentioned input side tubing belt assembly 23 (FIGS. 9 and 10) is disposed upstream of the rotary tucker 20 and the output side tucking belt assembly 23' is located between the rotary tucker 20 and the sealing assembly 22. The upstream side tubing belt assembly 23 includes the previously mentioned pair of endless belts 37 and 38. Since the parts associated with each belt are substantially the same, only the parts associated with the right belt 37 will be described in detail and equivalent parts associated with the left belt will be given the same numerals followed by the letter "*a*".

The belt 37 is trained around a drive roller 184, and an idler roller 186. The drive roller 184 is secured to a vertical shaft 188 journaled in a gear box 190 slidably received in a trackway 192 of the frame 70. A drive shaft 196 journaled on the frame 70 extends through both gear boxes 190,190a and is connected in driving engagement with the associated vertical shaft 188 by a right angle gear train 197. An elongated keyway in the driveshaft 196 and cooperating keys 198 allows the shaft to slide transversely within the gear boxes 190,190*a* while maintaining driving engagement with the shaft 188 for the drive roller 184 and the shaft (not shown) for the drive roller 184*a*. The drive shaft 196 is connected by a chain drive 200 to a shaft 202 that is journaled in the frame and is driven by means to be described hereinafter.

The two gear boxes 190,190*a* may be moved toward or away from each other to adjust engagement pressure between the side belts and the wrapping material and to accommodate articles of different widths, by a rod 204 journaled in the frame 70 and having right and left hand screw threads on opposite ends thereof. The threaded portions of the rod are received in complementary threaded portions of the two gear boxes. The rod 204 is manually rotated as required by a hand wheel 205 that is journaled on the frame and is connected to the rod 204 by a chain drive 206.

The idler roller 186 is journaled on a vertical shaft 208 secured to a longitudinally adjustable belt take-up slide 210 of an associated transversely adjustable carriage 212. The carriage 212,212*a* are adjusted transversely by manually turning a hand wheel 214 coupled to a rod 216 journaled in the frame 70 and having right and left hand screw threads received in similarly threaded portions of the associated carriage 212,212*a*. Tie bars 220,220*a* connect each carriage 212,212*a* to the associated aligned gear box 190,190*a*. Each tie bar has a vertical fin 222,222*a* secured thereto for supporting one end of each of a plurality of leaf springs 224,224*a*. The other ends of the springs are secured to a belt guide bar or upper shaft rider 226,226*a* which resiliently urges the belts against the packaging material and articles therein. A film and article supporting slide bar or lower shaft rider 228 is mounted midway between the belts 37,38 for supporting the articles as they are advanced toward the discharge end of the packaging machine.

The previously described side tubing belt assembly 23 is one arrangement for transporting the entubed articles into the tucking station. Other conveying arrangements such as top and bottom tubing belts or multiple pairs of fin wheels might be substituted for the side belts when transporting certain articles.

The side tubing belt assembly 23' is disposed between the rotary tucker 20 (FIG. 4) and the sealing assembly 22 and includes endless belts 240 and 240*a* (FIGS. 11 and 12). Since the parts associated with the belts 240 and 240*a* are substantially the same, only the right assembly will be described in detail and the left assembly will be assigned the same numerals followed by the letter "*a*".

The belt 240, as shown in FIG. 12, is trained around a drive roller 242, an idler roller 244, and a take-up roller 246 all of which are supported on a transversely adjustable carriage 248. The drive roller 242 is journaled on a dead shaft 250 and includes a tubular neck 251 secured to a gear 252 that meshes with a gear 254 secured, as by a sliding key 255, for rotation with, but adjustment axially of the shaft 256. The shaft 256 is journaled in the frame 70 and in the carriage 248 and is driven from the shaft 196 (FIG. 9) by a chain drive 258.

In order to adjust the belts 240 and 240*a* transversely, a transversely extending adjusting rod 260 is journaled on the frame and includes right and left hand threaded portions engaging complementary threaded portions in the carriages 248 and 248*a*. The carriages are slidably received in a trackway 261 of the frame 70. The rod 260 is manually rotated from a remote location by a hand wheel 263 (FIGS. 4 and 11) and sprocket 264 that are secured to a shaft 265 journaled in the frame 70. A first chain drive 266 connects the sprocket 264 to the double sprocket 268 journaled on a stub shaft 270. The double sprocket 268 is connected to a sprocket 271 on the adjusting rod 260 by a chain 272.

The previously described side tubing belt assembly 23' is one arrangement for transporting the entubed articles between the tucking station and the cross sealing station. Other conveying arrangements such as top and bottom tubing belts or chains may be desirable for certain types of articles.

An article supporting plate 274 is mounted on the frame 70 between the belts 240,240*a* to support the packaged articles after the tucking operation has been performed on the tube T. After passing through the sealing station SS, the articles move onto any suitable type of delivery conveyor 276 (FIG. 4) for delivering the articles from the machine. One such conveyor includes an endless belt 278 with its upper run positioned at substantially the same level as the plate 274. The belt 278 is trained around a drive pulley 280 secured to a shaft 282 journaled on the frame 70, a driven pulley 284 secured to a shaft 286 journaled on the frame, and a take-up pulley 288 journaled on the shaft 290 secured to the free end of a take-up arm 292 that is clamped in adjusted position on a shaft 294 that is secured to the frame. The delivery conveyor 276 is driven from an intermediate shaft 296 of the heat sealing and severing head 22 by a chain drive 298 connected between the shaft 296 and a stub shaft 299; and a gear drive 300 (FIG. 14) connected between the shaft 299 and the shaft 282. Power is directed to the shaft 296 by drive means to be described hereinafter.

Whereas the upstream tubing belts 37, 38 (FIG. 9) are adjusted to firmly grip the tube and articles therein, it will be understood that the downstream tubing belts 240, 240*a* are adjusted to provide a light pressure for keeping the tube taut as the tucker blades engage and tuck the film inwardly. The light pressure between the belts and film is sufficient to provide firm or distinct tuck lines, yet will allow slippage between the film and the belts 240, 240*a* to allow for the foreshortening of the film tube during the tucking operation.

Normally, the tubing belts 240,240*a* are driven at a slightly faster speed than the speed of the upstream belts 37,38 thereby providing the desired tension and separating the entubed product to the maximum spacing allowed by the tucked wrapping material, which material is partially sealed together at the tucking station as previously mentioned. This separation of the products to their maximum spacing after the tucking operation has been performed, provides maximum spacing between articles for easier entry of the sealing and cutting heads 162,170 (FIG. 4) at the sealing station SS.

However, when packaging products having a transverse cross-section that is approximately square and which is difficult to tack or hold in the tucked position at the tucking station, the belts 240,240*a* may be driven slightly slower than the belts 37,38 to prevent unfolding of the tucked material. In such cases, sufficient tension is maintained on the tubing T during tucking since the downstream article moves toward the upstream article by virtue of the pulling forces applied to the article during the process of tucking the tubular film inwardly. If additional tension is required, a resilient surfaced upper shaft rider (not shown but similar to the riders 226,226*a* of FIG. 9) may be placed above the film between the tucking and sealing station to frictionally grip the film and article therein between the lower shaft rider 228 and the resilient upper shaft rider. Such frictional engagement resists rearward movement of the foremost article during tucking thus tensioning the film during the tucking operation. It will be understood that the speed changes between the two side tubing belt assemblies may be provided by drive ratio adjustment means or by merely selecting the proper sprocket sizes.

A drive mechanism 310 (FIG. 14) is provided for controlling the operation of the several components of the wrapping machine 24. Although the details of most of the components of the drive mechanism are well known in the art, the general arrangement of the several components will be described in order to better define the overall operation of the machine and to point out the manner in which the several components may be adjusted relative to each other.

The drive mechanism 310 includes a main drive motor 312 that is coupled to a first right angle gear box 314 by a belt drive 316. An output shaft 318 of the gear box 314 is coupled to a second gear box 320 having one of its output shafts connected by a drive shaft 322 to a third right angle gear box 324. The output shaft of the third gear box 324 is connected by input gears 326,328 and 330 to the input shaft 332 of a differential assembly 334. A chain drive 336 connects the shaft 332 of the differential assembly to the rotatable planetary gear housing assembly 338 of a planetary drive assembly 340. A rotatable ring gear housing 339 of the planetary drive assembly 340 is connected by a chain drive 344 to a 1:1 shaft 345 which makes one revolution for each article moving through the machine. The shaft 345 is connected to and drives the input shaft 26*a* (FIG. 2) of the article receiving or feed conveyor 26 by a chain drive 346 to drive conveyor 26 in the direction indicated by the arrow 30 in FIG. 2. In order to time the lugs 28 of the conveyor 26 with other components of the wrapping machine 24, a sun gear (not shown) of the planetary drive assembly 340 is connected to a shaft 348 that is rotated relative to the planetary gear housing 338 and the ring gear housing 339. The sun gear shaft 348 rotatably supports the planetary gear housing 338 and the ring gear housing 339, and is rotated relative to both housings by a crank 350 and gear train 352. The crank 350 and sun gear (not shown) are held in desired stationary position during operation of the machine by a detent on the crank and a cooperating aperture of an apertured locking plate 354.

The differential assembly 334 is of a well known adjustable type wherein the input shaft 332 drive an output shaft 360 through gears secured to each shaft and connected in driving engagement with each other by meshing gears carried by a rotatable ring gear. In order to vary the speed of the output shaft 360 relative to the input shaft 332, a correction motor 370 is connected to a speed control shaft 372 by a chain drive 374. The speed control shaft has a pinion (not shown) keyed thereon which meshes with the aforementioned rotatable ring gear. The correction motor serves to vary the output speed of the output shaft 360 for the purpose of controlling the speed of the several components acting on the film upstream of the rotary tucker 20.

The correction motor 370 is controlled by a selector switch 376 (Candy switch) which cooperates with an electric eye assembly (not shown) for the purpose of detecting printed matter or the like on the film and registering the printed matter in the desired timing relationship to the conveyor lugs 28. These described components are commonly employed in print register control systems well known in the packaging art.

A gear 380 on the output shaft 360 of the differential assembly 334 drives an input gear 382 of a positively independently variable speed drive assembly 384. The drive assembly 384 is capable of providing speed changes up to about a 6 to 1 ratio by manually rotating a hand wheel 386 and control shaft 388 as required.

A first chain drive 390 is connected between the output shaft 392 of the variable speed drive assembly 384 and a shaft 394. The shaft 394 is connected to the web feed rolls 35 (FIG. 2) by a chain drive 396 thus permitting adjustment to feed in the proper amount of web for each wrapping cycle.

A second chain drive 400 connects the output shaft 392 to an idler shaft 402 which is, in turn, connected to the lower cone shaft 404 of a first adjustable cone pulley drive assembly 406, by a chain drive 408. The usual axially adjustable cone pulley drive belt 410 connects the lower cone 412 to the upper cone 414 which drives the fin wheel sealer 36 (FIG. 2) by a chain drive 416. A chain drive 418 connects the lower cone shaft 404 to the lower cone shaft 419 of a second adjustable cone pulley drive assembly 420 having its upper cone shaft 422 connected to the shaft 202 (FIG. 9) of the side tubing belt assembly 23 by a chain drive 424. As previously mentioned, the shaft 196 of the upstream tubing belt assembly 23 is connected to the shaft 256 of the downstream tubing belt assembly 23' by chain drive 258. Thus, the film drive components are all controlled by the differential assembly 334 and the variable speed drive assembly 384. The two described cone pulley assemblies 406 and 420 provide means to trim the velocities of the finwheel 36 and the outer surfaces of tubing belts assemblies 23 and 23' to achieve optimum tube tensioning control.

Figure 13:
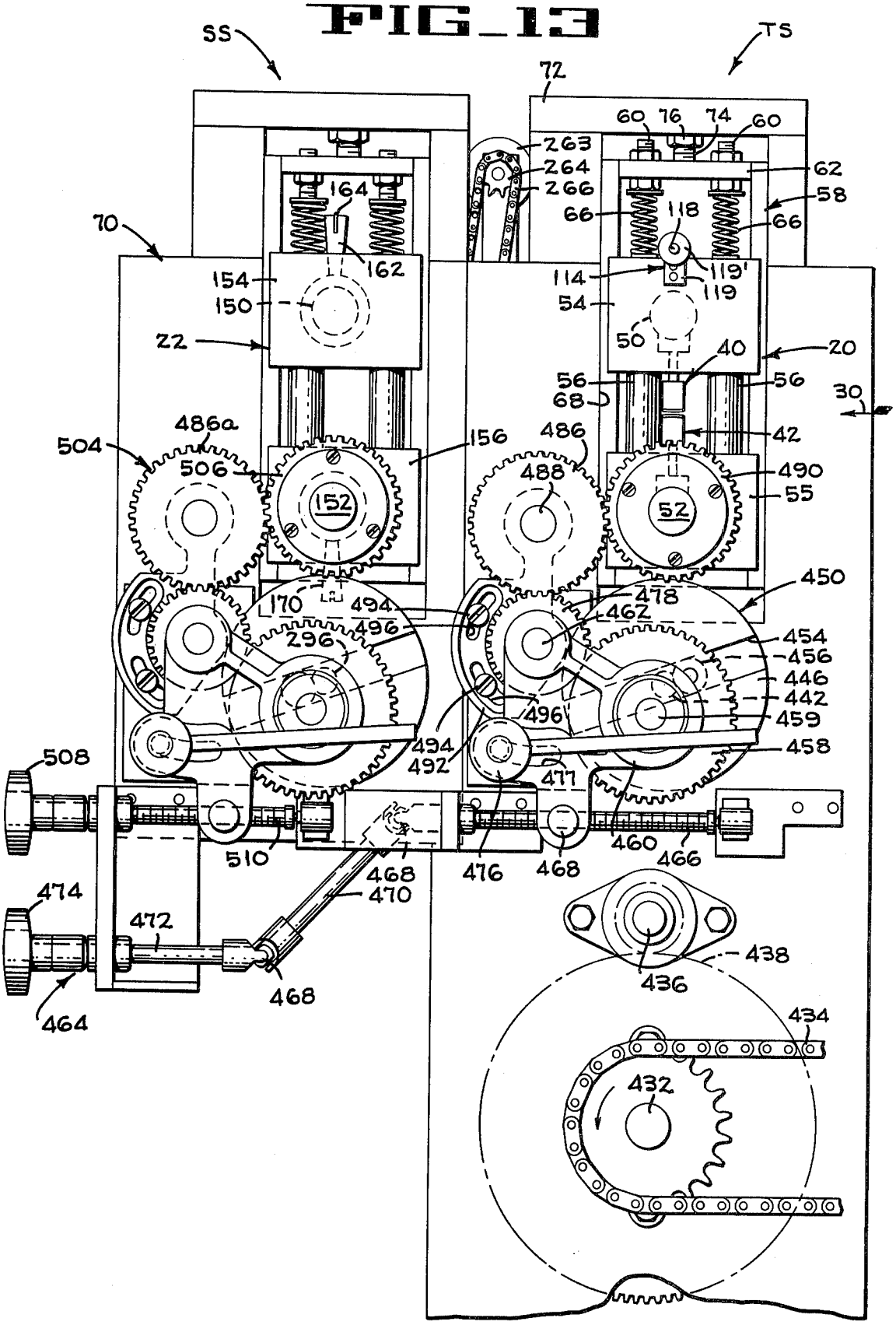
FIG. 13 is a left side elevation of the tucking and sealing stations illustrating metadiametric drives for the two stations.
Figure 14:
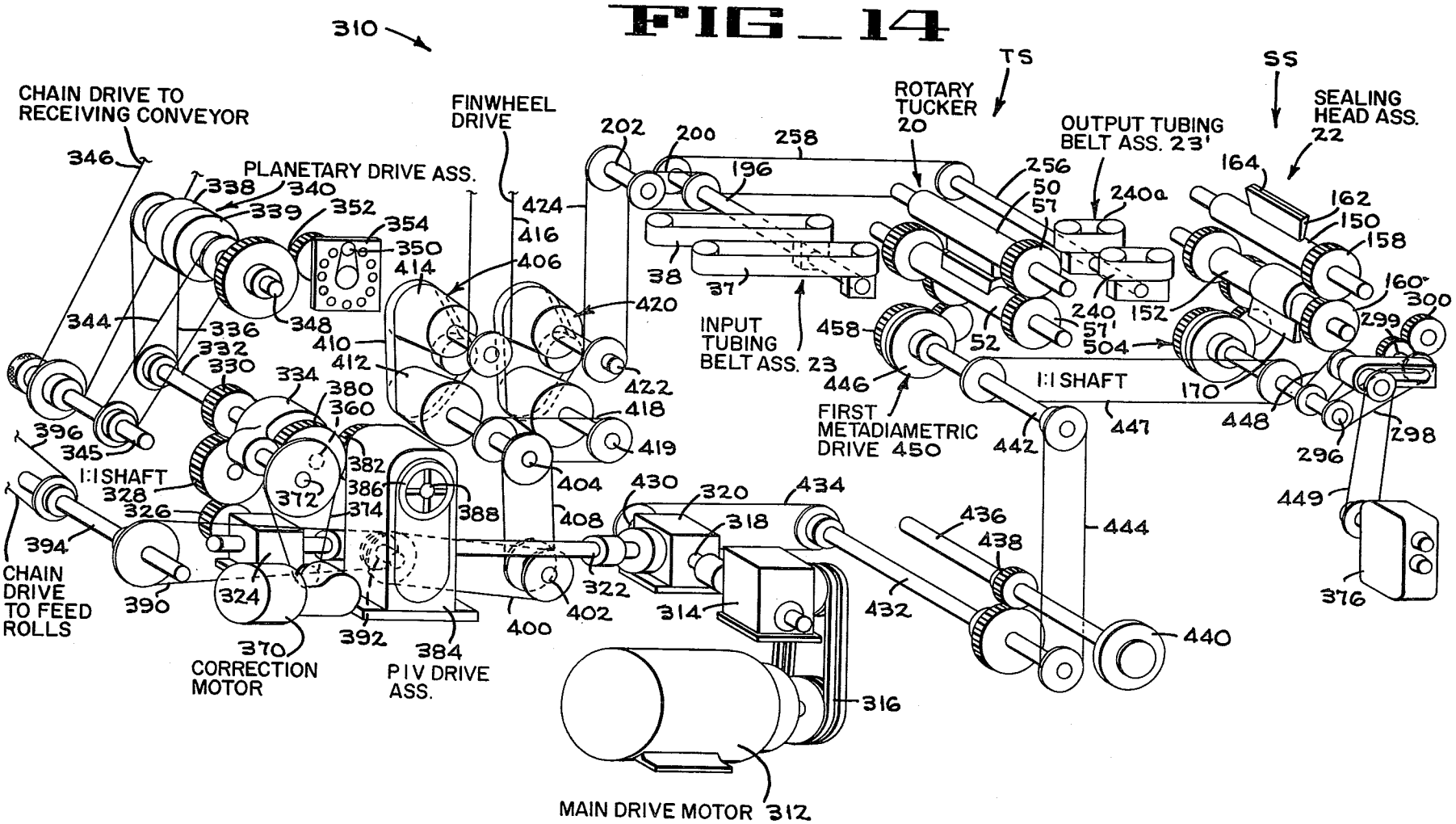
FIG. 14 is a diagrammatic perspective of the drive for the wrapping machine.
Figure 15:
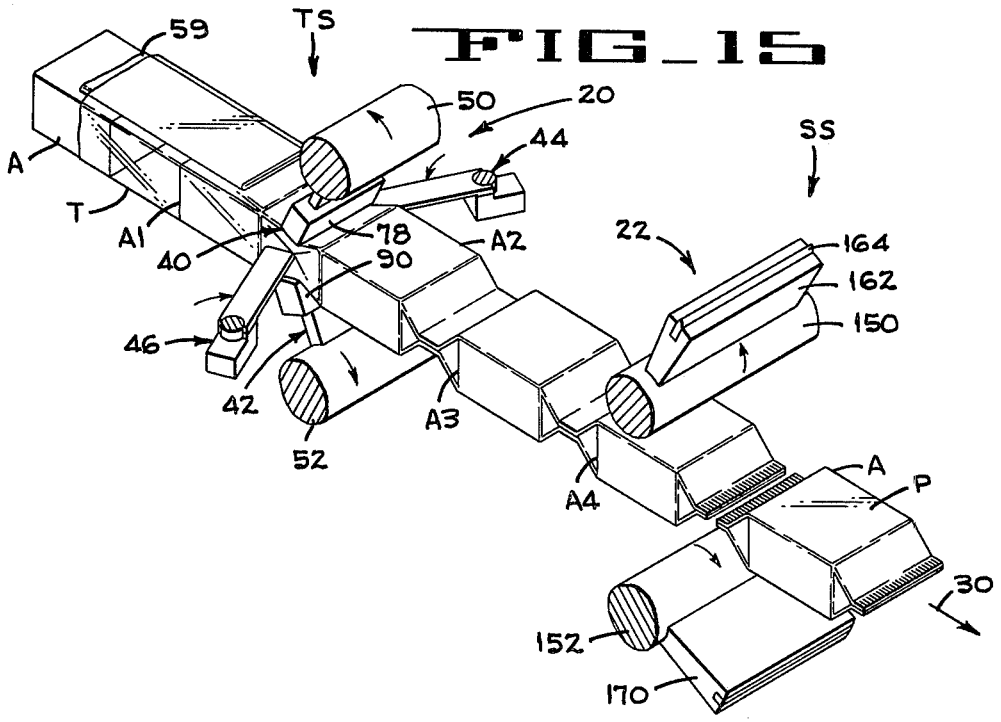
FIG. 15 is a diagrammatic operational view in perspective illustrating the operation of the four side rotary tucker and sealing head assembly.
Figure 16:
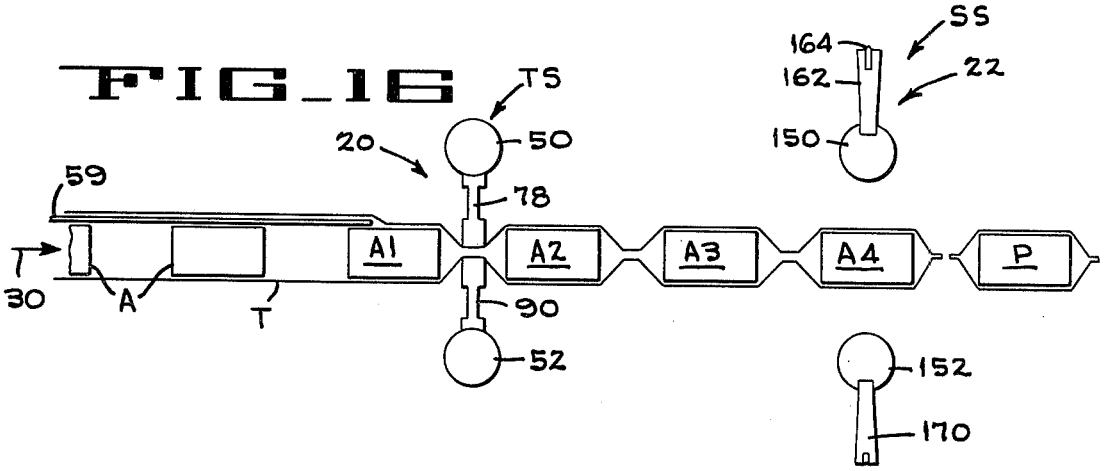
FIG. 16 is a diagrammatic side elevation illustrating the operation and desired timing of the rotary tucker and the sealing head assembly.
Figure 17:
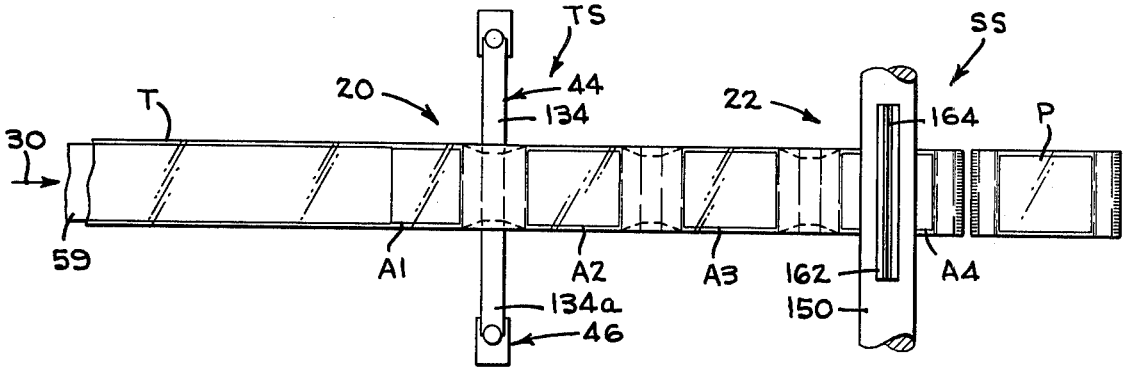
FIG. 17 is a diagrammatic plan view of FIG. 16.

The rotary tucker 20 sealing head assembly 22, and delivery conveyor 276 (FIG. 4) receive their power from a second output shaft 430 of the gear box 320. The second output shaft 430 is connected to an intermediate shaft 432 (FIGS. 8, 13 and 14) by a chain drive 434. The intermediate shaft 432 is connected to a timing shaft 436 by a gear drive 438 which timing shaft has a hand wheel 440 secured thereto for the purpose of manually operating the drive train to facilitate set up adjustments. The shaft 432 is also connected to a first metadiametric drive shaft 442 by a chain drive 444, which shaft also has a metadiametric driver 446 keyed thereto. The shaft 442 is driven one revolution for each package passing through the machine. It will also be noted that the cam shaft of the selector switch 376 is driven one revolution for each revolution of the shaft 442 by chain drives 447, 448 and 449 (FIG. 14).

The metadiametric driver 446 is part of a first metadiametric drive 450 which is fully disclosed in my British Pat. No. 1,362,060 which issued on November 27, 1974 and is incorporated by reference herein.

The function of the metadiametric drive 450 (FIG. 13) is to rotate the rotary tucker 20 one revolution for each package passing through the wrapping machine, but to vary the peripheral speed of the tucking heads 78,90, 134,134*a* (FIG. 3), during each revolution so that their average linear speed is substantially the same as that of the wrapping material during tucking. It will, of course, be understood that if two tucking heads are mounted on each shaft 50,52, that the metadiametric drive 450 will be geared to drive the shafts 50,52 one half revolution for each article moving through the machine.

Briefly, the metadiametric drive 450 (FIGS. 8–13) includes the driver 446 which includes a slot 454 that receives a cam follower 456 journaled on a gear 458. The gear 458 is rigid with a shaft 459 journaled in an adjustment bracket 460 (FIG. 13) that is pivoted about a stub shaft 462 and is adjusted through an arcuate range by an adjustment device 464. The adjustment device 464 includes a threaded shaft 466 screwed transversely into a stub shaft 468 pivoted to the bracket 460; a pair of universal joints 468 and cooperating connecting shaft 470, and an adjustment shaft 472 having a control knob 474 thereon. Rotation of the control knob thus pivotally adjusts the bracket 460 and gear 458, and the bracket is then locked in desired position by a threaded locking clamp 476 that extends through an arcuate slot 477 in the bracket. This adjustment in effect changes the amount of offset between the input shaft 442 and output shaft 459 centers and thereby adjusts the amount of cyclical speed variation to suit the wrapping application. The gear 458 meshes with a gear 478 that is journaled on the stub shaft 462. The gear 478 meshes with a drive gear 486 pivoted on a stub shaft 488. The drive gear 486 meshes with a gear 490 on the lower shaft 52 of the rotary tucker 20. Since the elevation of the lower shaft 52 must be adjusted to accommodate articles of different thicknesses, the gear 486 is journaled on stub shaft 488 which is secured to a bracket 492 pivoted about the shaft 462 and locked to the frame 70 in adjusted position by screws 494 extended through slots 496 in the bracket 492.

As illustrated in FIGS. 4 and 14, the chain drive 447 connects the metadiametric drive shaft 442 of the first metadiametric drive 450 to the previously mentioned second metadiametric drive shaft 296 of a second metadiametric drive 504 that drives a gear 506 (FIG. 13) on the lower shaft 152 of a sealing head assembly 22. The second metadiametric drive 504 is substantially the same as the first metadiametric drive 450 and accordingly will not be described in detail. It should be mentioned however that the second metadiametric drive 504 is controlled independently of the first drive by a knob 508 and threaded adjustment rod 510 as clearly illustrated in FIG. 13.

As previously mentioned, the delivery conveyor 276 (FIG. 4) is driven from the second metadiametric drive shaft 296 by the chain drive 298.

Although the operation of the wrapping machine 24 has been described in conjunction with the description of the several components of the wrapping machine, a summary of the operation will follow.

Prior to feeding articles A of a particular size and shape onto the article receiving conveyor 26, (FIG. 2) the several components of the wrapping machine 24 are first mechanically adjusted to handle these particular articles. In this regard, the vertical height of the rotary tucker 20 (FIG. 4) and the sealing head assembly 22 are adjusted to assure that the articles are vertically centered relative to the upper and lower tucking shoes 78,90 and sealing shoes 162,170. The sealing shoes 162,170 are angularly timed relative to the tucking shoes 78,90 so that both sets of shoes engage the portion of the web between the articles at the appropriate time depending upon the length of the articles. As mentioned previously, it is desirable that the tucking shoes complete their tucking operation between a pair of upstream articles prior to the engagement of the sealing shoes with the tucked material between a pair of downstream articles. The required initial angular setting may be accomplished by advancing or retarding one of the sprockets in the chain drive 447 relative to the other sprocket. With the speed of the adjustable speed motor 312 (FIG. 14) determined to provide the desired speed of articles through the machine, the hand wheel 386 of the variable speed drive 384 and the two adjustable cone drives 406 and 420 are adjusted to drive the packaging material at the correct speed. The timing of the lugs 28 of the article receiving conveyor 26 is advanced or retarded to the proper condition by operating the crank 350 which adjusts the planetary drive assembly 340 as required. Although the conveyor 26 with lugs 28 spaced a predetermined distance apart may be driven slightly slower or faster than the packaging material to accommodate batches of articles that differ slightly in length; if large differences in article lengths are present, it is preferable that a new conveyor with appropriately spaced lugs be substituted for the original conveyor. If printed wrapping material is used, the timing of selector switch 376 is first adjusted to locate the printed material relative to the conveyor lugs 28. After operation is commenced, a photoelectric scanner (not shown) and the selector switch 376 serve to actuate the correction motor 370 which advances or retracts the differential assembly to maintain the film properly registered with the conveyor lugs 28.

Having reference to FIGS. 15–19, the spaced articles A within the tube T of wrapping material first enters the tucking station TS at which time the vacuum tube 59 is evacuating air from between the articles A. The heated upper and lower tucking shoes 78,90 and the side tucker shoes 134,134*a* simultaneously enter the space between the two adjacent articles A1 and A2 to tuck the four sides of the packaging material inwardly and to partially heat seal or tack the upper and lower panels together at least at the transverse central portion of the tucked material. During this time, the upstream tubing belts 37,38 (FIG. 9) firmly grip the upstream article A1 and the downstream belts 240,240*a* engage the article A2 with sufficient force to tension the film to form distinct tuck lines from all adjacent corners of the articles but with insufficient force to preclude slippage of the article A2 and surrounding wrapping material relative to the downstream tubing belts 240,240a. As the four panels of the packaging material are tucked inwardly, the downstream article A2 (FIGS. 15-17) is pulled towards the upstream article A1 reducing the space between the articles A1 and A2. Although this reduction of article spacing occurs only at the tucking station TS, the downstream articles such as A3,A4 that remain attached to the tube T of wrapping material do experience variations of velocity as the upstream tucking operation takes place. Subsequent to the tucking operation, the heated sealing and severing bars 162 and 170 engage and seal the tucked material between articles A3 and A4 at the sealing station SS while at the same time the knife 164 severs the downstream package containing article A4 from the tube T providing a finished package as illustrated in FIG. 19. It will of course be understood that the severing knife 164 may be removed from the sealing bar 162 if it is desired to have the separately packaged articles connected to one another. Likewise a perforating device could be employed to produce perforated connections between packaged articles if desired.

It is recognized that when packaging certain stacked, slippery articles such as individually wrapped cheese slices or the like, the stack alignment may be disturbed by frictional drag forces between the top of the stack and the stationary vacuum tube 59. Accordingly, in such installations the air evacuating tube 59 may be replaced by a web perforating mechanism 520 as an alternate air evacuating system and as illustrated in FIGS. 20,21 and 22.

In accordance with the second embodiment of the invention the web perforating mechanism 520 is mounted upstream of the forming plow 32 (FIG. 2) by structure similar to that used at the tucking station. The mechanism 520 includes an upper shaft 522 and a lower shaft 523 with the upper shaft either driven directly from the 1 to 1 shaft 345 (FIGS. 2 and 14) by a chain drive 524 and reverse gears (not shown) if the perforating knife 526 is properly sized; but preferably through a third independently controlled metadiametric drive similar to the drive 450, which third drive is also driven from the shaft 345. The lower shaft 523 is driven from the web feed roll drive shaft 394 by a chain drive 528.

The web perforating mechanism 520 includes the upper shaft 522 (FIGS. 20 and 21) having a radially extending perforating knife 526 secured thereto and terminating in a plurality of sharpened V-shaped cutters 526a (FIG. 22) projecting downwardly therefrom and arranged to perforate the web disposed between the knife 526 and a hardened steel sleeve 527 on the lower shaft 523 at a point which will lie substantially midway between the two adjacent articles after the web of wrapping material advances downstream through the tucking station TS. Thus the wrapping material is perforated upstream of the forming plow 32 before being folded. The knife 526 severs and thus forms perforations in the web of wrapping material but the severed portions of the web remain attached to the web so that web slugs do not contaminate the articles. As indicated in FIG. 21, the web of wrapping material W is guided through the perforating mechanism 520 when in its unfolded condition by idler rollers 530 and 532. The rollers are journaled on arms 534 secured to the frame 70.

Thus, during tucking operation at the tucking station TS, air within the tube T between adjacent articles flows out of the perforations in the web due to the increased pressure resulting from inwardly folding the package ends. As the tucked area enters the sealing station SS, the sealing bars 162,170 heat seal the area of the film which includes the air bleed perforations thus closing the perforations and providing air tight packages.

From the foregoing description it will be apparent that the article wrapping machine of the present invention includes a rotary tucker which includes a pair of rotary transverse tucking shoes and a pair of side tucking shoes that simultaneously tuck all four side walls of the wrapping material inwardly at a single station. If the wrapping material is a thermosealing material, certain of the tucking shoes are heated to partially seal the tucked end extensions together. During the tucking operation the tube of wrapping material is tensioned between upstream and downstream tubing belt assemblies with the upstream assembly firmly gripping the wrapping material and articles therein, and with the downstream assembly gripping the material with sufficient force to tension the wrapping material while allowing the wrapping material and article to slide rearwardly relative thereto since the tucking operation reduces the distance between articles. The rotary tucker operates in combination with a rotary sealing head assembly which seals the ends of the packages together and severs the packages from the tube. An adjustable drive mechanism is provided for controlling the speed of the tucking and sealing mechanisms relative to the web and article speed, and is capable of being readily adjustable to handle products of different lengths. Means are also provided to evacuate air from the tube of wrapping material.

Although the best mode contemplated for carrying out the present invention has been herein shown and described, it will be apparent that modification and variation may be made without departing from what is regarded to be the subject matter of the invention.

I claim:

1. In a wrapping machine wherein a series of longitudinally spaced articles are inserted in a moving tube of wrapping material formed from a flat strip of thermoplastic material, said tube having top and bottom walls and side walls and being laden with such longitudinally spaced articles, means for feeding the laden tube along a longitudinal path, means for tucking the side walls of the tube portions between articles toward the longitudinal axis of the tube, rotary vertically spaced shafts located above and below the path of the tube, top and bottom tube wall deflecting and bonding means mounted on said shafts, means for simultaneously rotating said shafts and tube deflecting and bonding means in opposite directions for simultaneously deflecting and bonding the top and bottom walls of the tube being fed therebetween at portions of the tube between articles, and means for transversely severing the tube at the bond; the improvement wherein said top and bottom tube wall deflecting and bonding means comprises upper and lower elongate, generally rectangular shoes respectively secured to said shafts, said shoes each having a single tube deflecting and bonding foot that cooperate at each bond, said feet each having convexly curved central tube bonding portions flanked by radially inwardly recessed portions at each side of the bonding portion to thereby cooperatively define end slots in the feet as the central tube bonding portions deflect the top and bottom walls of the tube, said slots being completely open and un-confined by said shoes at their ends and at their upstream and downstream edges, means for heating said feet to effect bonding of the deflected top and bottom walls of the tube by the central tube bonding foot portions along a single, relatively narrow transverse central area, said side wall tucking means comprising simultaneously rotatable shafts located adjacent opposite side walls of said tube, thin blade-like tucking shoes secured to and projecting from said shafts and rotating in a plane containing said slots, said tucking shoes having free end portions for simultaneously passing through their respective slots to tuck the tube side walls so that the innermost portion of each tuck is adjacent the ends of the associated central tube bonding portions of said feet substantially concurrently with the bonding operation, said tucking shoes being positioned so that a single end portion enters its respective slot during the deflection and bonding of the tube by the central portions of said feet, said tube feeding means comprising means for tensioning the unoccupied tube portions between articles for providing controlled deflection and tucking thereof, said tensioning means comprising longitudinally spaced pairs of laterally opposed belts making frictional contact with opposed walls of the tube, one pair of said belts being located upstream of said upper and lower tube wall deflecting and bonding means while the other pair is located downstream thereof, and means for driving said pairs of belts at different speeds for maintaining tension of said unoccupied tube portions between spaced articles and rendering said tube portions taut both upstream and downstream of the tucking and bonding means during the tucking and bonding operations at said tube portions, said downstream belts accommodating longitudinal movement of the downstream article toward the upstream article during said tube deflecting and tucking operations, said tucked side portions and said top and bottom wall portions of the tube being unconfined between the zone of said tucking shoes and bonding shoe portions and the ends of articles disposed directly upstream and downstream thereof during the aforesaid action of said tucking shoes and bonding shoe portions, said tube severing means being disposed downstream of said tube deflecting and bonding means and including means for bonding the tube walls entirely across the width of the tube.

* * * * *